United States Patent [19]

Frings et al.

[11] Patent Number: 4,470,767

[45] Date of Patent: Sep. 11, 1984

[54] VACUUM PUMP WITH OVERLOAD PROTECTION VALVE

[75] Inventors: Heinz Frings, Cologne; Karl-Heinz Ronthaler, Zülpich, both of Fed. Rep. of Germany

[73] Assignee: Leybold-Heraeus GmbH, Cologne, Fed. Rep. of Germany

[21] Appl. No.: 82,602

[22] Filed: Oct. 9, 1979

[30] Foreign Application Priority Data

Oct. 9, 1978 [DE] Fed. Rep. of Germany ..... 2844019

[51] Int. Cl.[3] ..... F04B 49/08

[52] U.S. Cl. ..... 417/310; 137/533.27; 137/533.31

[58] Field of Search ..... 417/310, 309, DIG. 1; 137/533, 533.27, 533.31

[56] References Cited

U.S. PATENT DOCUMENTS

| | | | |
|---|---|---|---|
| 862,714 | 8/1907 | Constantinov | 137/533.31 X |
| 1,844,613 | 2/1932 | Thompson | 137/533.27 X |
| 2,642,260 | 6/1953 | Moore | 137/533.27 X |
| 2,849,863 | 9/1958 | Dubrovin | 417/310 X |
| 3,148,623 | 9/1964 | Sayers | 417/310 X |
| 3,632,240 | 1/1972 | Dworak | 417/DIG. 1 X |

OTHER PUBLICATIONS

Balzers Catalog, Komponenten für die Vakuumtechnik, 1977.

*Primary Examiner*—Richard E. Gluck
*Attorney, Agent, or Firm*—Spencer & Frank

[57] ABSTRACT

In a vacuum pump having a housing presenting a suction side and a pressure side, a connecting line connected between the suction side and the pressure side and a weighted valve mounted in the connecting line and having a part which is movable to open the valve in order to place the suction and pressure sides in communication when a maximum permissible pressure difference between the suction and vacuum sides is exceeded, the valve is mounted so that the axis of movement of the valve part forms an angle of 45° with the direction of the pumping action between the suction and pressure sides, whereby the weighted valve will function properly with the pump oriented to produce its pumping action in either the vertical or the horizontal direction.

14 Claims, 3 Drawing Figures

VACUUM PUMP WITH OVERLOAD PROTECTION VALVE

BACKGROUND OF THE INVENTION

The present invention relates to a vacuum pump, particularly a vacuum pump of the rotary blower type.

A pump of this type is provided with a connecting line between its suction, or inlet, side and its pressure, or outlet, side as well as with a weighted, or weight biassed, valve which is disposed in this connecting line and opens when a maximum permissible pressure difference is exceeded. With such a valve it is possible to avoid mechanical and thermal overloads on the pump, which occur particularly with rotary blower vacuum pumps if a maximum permissible pressure difference between the suction side and the pressure side is exceeded.

A vacuum pump of this type is described in the catalog of the firm Balzers AG, entitled "Komponenten für die Vakuumtechnik" [Components for the Vacuum Art], 1977 edition, at page C8. The rotary blower vacuum pump described therein has an overflow conduit with an overload valve having a vertically oriented sealing element. The drawback of this prior art pump is that it can be operated when oriented to effect pumping in only one conveying direction, namely vertically from top to bottom. The reason for this is the requirements imposed by the weighted overload valve which exhibits the desired characteristics only when oriented in the position shown in the catalogue. In any other installation position, it cannot operate properly.

German Offenlengungsschrift [Laid-open Application] No. 1,939,717 discloses a rotary blower pump of such a design that it can be operated while oriented to have either a vertical or a horizontal conveying direction. For the reasons described above, a weighted valve of the type described earlier herein cannot be used in this rotary blower pump. It would be conceivable to use a valve whose operation is independent of pump orientation, for example a spring biassed valve, instead of the weighted valve. However, such valves have considerable drawbacks when used as overload valves.

In rotary blower pumps with bypass lines provided with spring biassed overload valves, there frequently occur strong self-induced flow pulsations in the system constituted by the rotary blower pump and the overflow line, and with a spring biassed valve such flow pulsations may result not only in loud noise but also in considerable vibration and hammering of the valve, leading to destruction of the pump and of the valve. The reason for this, obviously, is that a rotary blower pump having an overload line can act like an amplifier with feedback, the rotary blower pump acting as the amplifier and the overload line with the spring biassed overload valve acting as the feedback.

Drawbacks of this type are rarely exhibited by weighted overflow valves. Their drawback, however, is their position dependence so that a prior art vacuum pump equipped with such a valve can be operated only when oriented to effect pumping in one conveying direction.

SUMMARY OF THE INVENTION

It is an object of the present invention to enable a vacuum pump of the above-described type which has a weighted overflow valve to be operated without modification to effect pumping in either the vertical or horizontal conveying direction.

This and other objects are achieved, according to the present invention, by mounting such valve so that its axis of movement forms an angle of 45° with the axis of the conveying direction. Then, independently of whether the vacuum pump is oriented to have either a vertical or horizontal conveying direction, the axis of the weighted valve forms an angle of 45° with the vertical so that it has identical properties in either one of the two installation position orientations of the vacuum pump and thus can perform its function in either one of these two positions. The weighted valve is thus arranged in the vacuum pump in such a way that in each one of the two installation positions of the pump the requirement for position dependence of the valve has been met. No modification of the valve is required when the pump is moved between one and the other of those positions.

DESCRIPTION OF THE PREFERRED EMBODIMENTS

Figure 1:
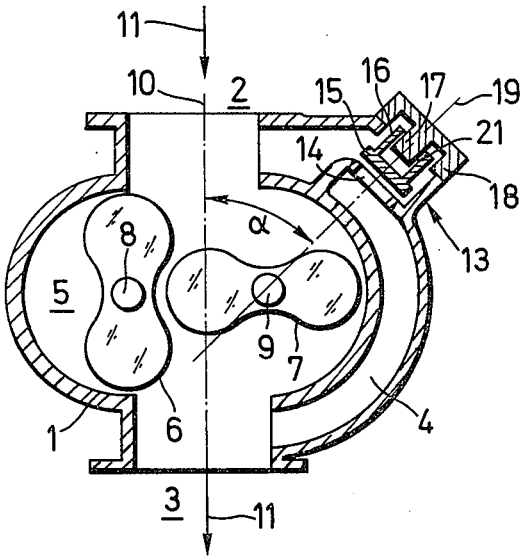
FIG. 1 is a cross-sectional, elevational view of a rotary blower pump according to a preferred embodiment of the invention taken perpendicularly to the axes of the rotary vanes, oriented to present a vertical conveying direction.
Figure 2:
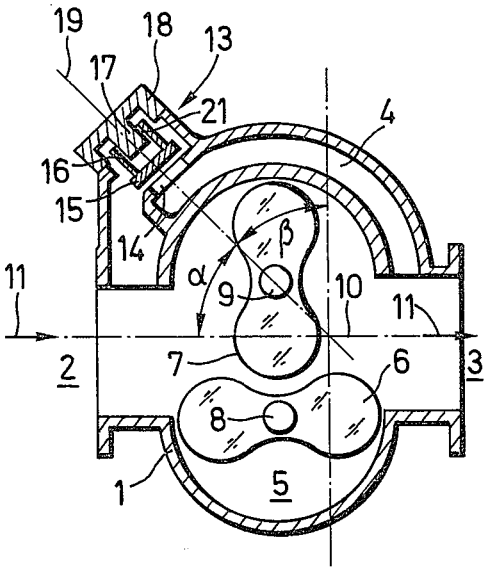
FIG. 2 is a view similar to that of FIG. 1 showing the rotary blower pump of FIG. 1 oriented to provide a horizontal conveying direction.

FIGS. 1 and 2 show a rotary blower pump having a housing 1 presenting a suction, or inlet, side 2, a pressure, or outlet, side 3 and a connecting line 4 between the suction side 2 and the pressure side 3. In the pump cylinder 5 there are two lobelike rotary vanes 6 and 7 which rotate about respective, mutually parallel axes 8 and 9 in an interengaging manner, i.e. in the manner of gears, and thus produce the conveying, or pumping, effect. The rotary pistons rotate in opposite directions and without contact with the cylinder wall. In FIGS. 1 and 2, the conveying direction is shown by a chain line 10 and arrows 11. The gap between each vane and the cylinder walls and the gap between the vanes themselves at the point where they are adjacent one another is about 1/10 mm.

The overload valve 13 is disposed in the overload line 4 and is composed of an opening 14 which is to be sealed and which is enclosed by a value seat and a sealing element 15. A bearing bush 16 is fastened to the sealing element 15 and has associated with it a bearing pin 17. The bearing pin 17 is fastened to a housing member 18 forming a removable cover so that the valve is easily accessible for maintenance work.

The longitudinal axis 19 of valve 13 is shown by a chain line and is so oriented that it forms an angle $\alpha$ of 45°. with the conveying direction 10. As a result, in the two installation positions of the pump shown in FIGS. 1 and 2, the axis 19 likewise forms an angle of 45° with the vertical. In the installation position of FIG. 1 with vertical conveying direction, this is represented by the angle $\alpha$. In the installation position of FIG. 2 with horizontal conveying direction, it is represented by the angle $\beta$. In this latter installation position, the angle $\alpha$ is complementary to the angle $\beta$ with respect to the 90° angle between the horizontal and the vertical.

With the above-described arrangement it has become possible that in spite of the change in conveying direction between vertical and horizontal, the spatial installation position, or orientation, of the weighted valve 13 does not change. The resetting, or closing, force on the valve 13, which depends on the weight of the sealing element 15 and of the bearing bush 16 as well as on the position of the valve axis 19, is thus the same in both cases.

In order to assure perfect operation of the valve 13 when its axis of movement lies at an angle of 45° to the vertical, the bearing faces of elements 16 and 17 which slide against one another must have good operating, and preferably dry operating, characteristics. This can be realized by the selection of respective materials which are suitable relative to one another for such purposes. In one such suitable pairing, one of these faces is made of polytetrafluroethylene (PTFE), while the material, for the counterface, is selected from those materials which can be given a smooth surface, e.g. aluminum. In FIGS. 1 and 2, such a pairing of materials is indicated. For this purpose, the interior of the bearing bush 16 is provided with a ring 21 of PTFE which forms the bearing face. The bearing pin 17 itself is made of aluminum. The fact that the diameters of the cylindrical bearing faces are as large as possible, approximately equal to or greater than that of the opening 14 to be sealed, also serves to assure reliable operation.

With bearing faces of this type the sealing element can be mounted with very little play, i.e. with a bearing gap of the order of magnitude of a few one hundredths of a millimeter. If care is taken in the construction of such a bearing to assure that the region enclosed by the sealing element 15, the bearing bush 16 and the bearing pin 17 is sealed against the exterior except for the bearing gap, movement of the sealing element will simultaneously produce the effect of a shock absorber since any gas remaining in that region can be pressed or sucked through the bearing gap only against great resistance.

At the same time, the bearing can act as a friction brake if care is taken that the properties of such a brake are not made ineffective by the removal of material or by the fact that complicated resetting devices must be provided. With the above-mentioned pairing of materials, i.e. PTFE and aluminum, wear in the bearing bush can be kept low and by depositing the softer bearing material on the harder bearing pin, the the gap between the bearing bush 16 and bearing pin 17, in effect, is not changed. It was an unexpected discovery that the removed particles of PTFE did not disappear, but were deposited on the bearing pin.

Figure 3:
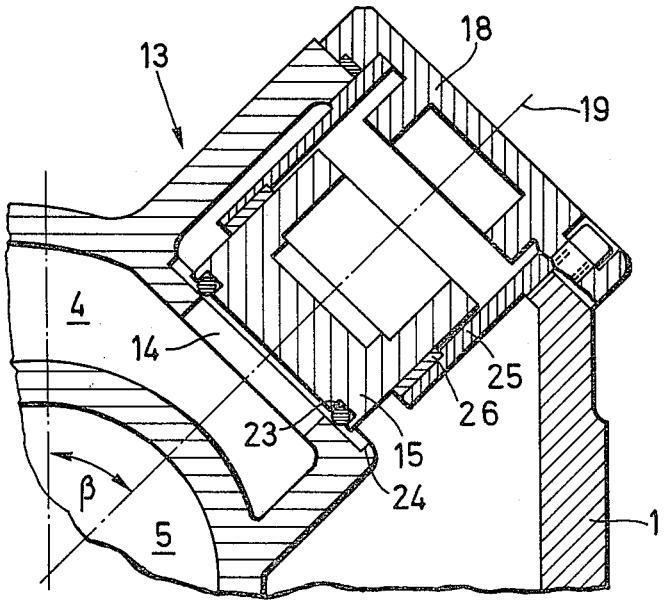
FIG. 3 is a cross-sectional detail view, to an enlarged scale, of an embodiment of an overload according to the invention.

FIG. 3 shows another embodiment of an overload valve according to the invention. In this embodiment, the sealing member 15 is essentially piston-shaped. On its one frontal face facing the opening 14, a sealing O-ring 23 is installed. A groove 24 which faces the sealing ring and encloses the opening 14 forms the valve seat. The piston-shaped sealing element 15 is guided in a cylinder 25 which itself is fastened to the cover-like housing member 18. The axis 19 of the cylinder 25 and thus of valve 13 forms the angle $\beta$ of 45° with the vertical.

The slide bearing faces of this overload valve are formed by the outer cylindrical face of the piston 15, which is preferably made of aluminum, and by the inner cylindrical face of a bearing ring 26 of PTFE which is supported by the interior face of cylinder 25. In this embodiment as well, there is no connection between the interior of the cylinder 25 and the outside except through the bearing gap so that this valve likewise produces a shock absorbing effect.

The overload valve has to open when a maximum permissible pressure difference between the suction side and the pressure side is exceeded for a longer time. If this happens only for a few seconds, there is no risk for the pump. Therefore, a rapid reaction of the sealing element to change of the pressure difference is not necessary. The reaction time depends on the size of the gap, which is about five hundredths of a millimeter. In this case the overload valve according to the invention has good shock absorbing as well as reaction time properties.

It will be understood that the above description of the present invention is susceptible to various modifications, changes and adaptations, and the same are intended to be comprehended within the meaning and range of equivalents of the appended claims.

What is claimed is:

1. In a vacuum pump having a housing presenting a suction side and a pressure side, a connecting line connected between the suction side and the pressure side and a weighted valve mounted in the connecting line and having a part which is movable to open the valve in order to place the suction and pressure sides in communication when a maximum permissible pressure difference between the suction and pressure sides is exceeded the valve part being movable to close the valve primarily under the influence of the weight of the valve part, said pump effecting a pumping action such that the direction in which fluid is conveyed at said suction side lies in a straight line with the direction in which the fluid is conveyed at said pressure side, the improvement wherein the direction of movement of said valve part forms an angle of 45° with the straight line direction of the pumping action between said suction and pressure sides, and forms an angle of 45° to the horizontal when said pump is in operation.

2. Pump as defined in claim 1 constituted by a rotary blower pump.

3. Pump as defined in claim 2 wherein the movable part of said valve comprises a movable sealing element having a bearing bush, and said valve further comprises a bearing pin operatively associated with said bush for guiding the movement of said sealing element and fastened to a portion of said pump housing.

4. Pump as defined in claim 3 wherein said bush engages said pin to present a gap of minimum size therebetween and said sealing element, said bearing bush and said bearing pin are formed to enclose a space which communicates with the outside only via the gap between said bush and said pin.

5. Pump as defined in claim 3 wherein said valve further comprises means defining an opening in said connecting line, which opening is blocked by said sealing element when said valve is closed, said opening and said pin are both cylindrical, and the diameter of said opening is no greater than that of said pin.

6. Pump as defined in claim 3 wherein said bearing bush and said pin present bearing surfaces which engage one another and which are made of respective materials selected to form a dry slide bearing.

7. Pump as defined in claim 2 wherein said movable part is an essentially piston-shaped sealing element, and said valve further comprises a cylinder in which said sealing element is guided for movement and which is fastened to a portion of said pump housing.

8. Pump as defined in claim 7 wherein said cylinder engages said sealing element to present a gap of minimum size therebetween and said sealing element, said cylinder and said housing portion are formed to enclose a space which communicates with the outside only via the gap between said cylinder and said sealing element.

9. Pump as defined in claim 7 wherein said valve further comprises means defining an opening in said connecting line, which opening is blocked by said sealing element when said valve is closed, and the diameter of said opening is no greater than the inner diameter of said cylinder.

10. Pump as defined in claim 7 wherein said sealing element and said cylinder present bearing surfaces which engage one another and which are made of respective materials selected to form a dry slide bearing.

11. Pump as defined in claim 6 or 10 wherein the material of one of said bearing surfaces is polytetrafluoroethylene and the other of said bearing surfaces has a smooth surface.

12. Pump as defined in claim 11 wherein the material of said other one of said bearing surfaces is aluminum.

13. Pump as defined in claim 4 or 8 wherein the gap has a width of no more than a few hundredths of a millimeter.

14. Pump as defined in claim 3 or 7 wherein said housing portion is a removable cover member.

* * * * *